US011220416B1

(12) United States Patent
Hamlik et al.

(10) Patent No.: US 11,220,416 B1
(45) Date of Patent: Jan. 11, 2022

(54) RAKED BLADE LOAD CLAMP

(71) Applicant: Rightline Equipment, Inc., Rainier, OR (US)

(72) Inventors: Jim D. Hamlik, Vancouver, WA (US); Jeffrey D. Hamlik, Kelso, WA (US)

(73) Assignee: RIGHTLINE EQUIPMENT, INC., Rainier, OR (US)

( * ) Notice: Subject to any disclaimer, the term of this patent is extended or adjusted under 35 U.S.C. 154(b) by 0 days.

(21) Appl. No.: 16/842,742

(22) Filed: Apr. 7, 2020

Related U.S. Application Data

(60) Provisional application No. 62/830,538, filed on Apr. 7, 2019.

(51) Int. Cl.
*B66F 9/18* (2006.01)
*B66F 9/14* (2006.01)

(52) U.S. Cl.
CPC ..... *B66F 9/183* (2013.01); *B66F 9/149* (2013.01)

(58) Field of Classification Search
CPC ..... B66F 9/183; B66F 9/149
See application file for complete search history.

(56) References Cited

U.S. PATENT DOCUMENTS

| | | | | |
|---|---|---|---|---|
| 3,370,880 | A * | 2/1968 | Carliss | B66F 9/183 294/87.1 |
| 3,433,376 | A * | 3/1969 | Jordan | B66F 9/183 414/621 |
| 3,450,288 | A * | 6/1969 | Walsh | B66F 9/183 414/667 |
| 7,118,148 | B1 * | 10/2006 | Davis | B66F 9/183 294/119.1 |
| 8,517,440 | B1 * | 8/2013 | Dosso | B66F 9/183 294/106 |
| 10,280,056 | B1 * | 5/2019 | Davis | B66F 9/183 |
| 10,377,617 | B2 * | 8/2019 | Schindlbeck | B62D 65/00 |

* cited by examiner

*Primary Examiner* — Mark C Hageman
(74) *Attorney, Agent, or Firm* — Rylander & Associates, PC; Philip R. M. Hunt

(57) ABSTRACT

A clamp assembly for a lift truck load handler that has a clamp leading edge that is raked back from bottom to top. The clamp leading edge is a blade edge, angled inward from the leading edge. The clamp assembly typically has a clamp plate with a front edge that forms at least part of the clamp leading edge. The clamp assembly typically has a toe plate that is harder and more wear-resistant than the clamp plate that wraps around a front edge of a lower portion of the clamp plate. The toe plate has a front edge that aligns with a front edge of the upper portion the clamp plate that together form the clamp leading edge.

23 Claims, 9 Drawing Sheets

RAKED BLADE LOAD CLAMP

CROSS-REFERENCE TO RELATED APPLICATIONS

This application claims the benefit of U.S. Provisional Application No. 62/830,538, filed 7 Apr. 2019, incorporated herein by reference.

FIELD OF THE INVENTION

The present invention relates to cargo handling equipment. More particularly, the present invention relates to carton clamps for use primarily with lift trucks.

BACKGROUND

Material handling vehicles such as lift trucks are used to pick up and deliver loads between stations. A typical lift truck 10 has a mast 12, which supports a load-lifting carriage 14 that can be raised along the mast 12 (see FIG. 1). The carriage 14 typically has one or more carriage bars 16 to which a fork frame 18 is mounted. The carriage bars 16 are coupled to the mast in a way that allows the lift truck 10 to move the carriage bars 16 up and down, but not laterally relative to the truck. The fork frame 18 carries a pair of forks 20. An operator of the lift truck 10 maneuvers the forks 20 beneath a load prior to lifting it.

Instead of forks 20, a lift truck 10 may have a load clamp assembly 32 coupled to its mast 12 (See FIG. 2). The load clamp assembly 32 typically comprises a frame 40, one or more actuators 36 and two clamp arms 34. The actuators 36 are configured to move the clamp arms 34 toward or away from each other with actuator rods 38. The clamp arms 34 typically have a gripping material on the inside surfaces that contact the load. The gripping material, such as rubber or polyurethane, provides high friction contact surface for gripping the load and also provides a compressible and resilient contact surface to protect the load from superficial damage from the clamp arms 34. In use, the operator of the lift truck 10 approaches a load to be carried, such as a stack of cartons or a large appliance, such as a refrigerator. As the lift truck 10 approaches the load, the operator uses controls to open the gap between the clamp arms 34 wider than the load and may adjust the height of the clamp arms 34 so they will engage the load in a suitable location. The operator then maneuvers the lift truck 10 to straddle the load between the clamp arms 34. When the clamp arms 34 are positioned suitably around the load, the operator uses controls to bring the clamp arms 34 together, grasping the load. The operator then uses other controls to raise the load clamp assembly 32, raising the load off the floor, the load held between the clamp arms 34 by friction. The operator then drives the load to a desired location.

Load clamps, also known as carton clamps, are well known, but existing designs are designed for the lift truck 10 primarily for lifting a single isolated carton. Typically, they approach a carton with the clamp arms 34 spread wider than the carton, maneuver so that the carton is between the clamp arms 34 and then close the clamp arms 34 until they grasp the carton. Then the carton can be lifted and moved. The standard carton clamp design makes it problematic for the clamps to grasp one carton in the middle of a row of cartons in which the cartons are in contact with each other or to grasp a carton against a wall.

BRIEF DESCRIPTION OF THE DRAWINGS

The present invention will be described by way of representative embodiments, illustrated in the accompanying drawings in which like references denote similar elements, and in which.

DETAILED DESCRIPTION

Before beginning a detailed description of the subject invention, mention of the following is in order. When appropriate, like reference materials and characters are used to designate identical, corresponding, or similar components in different figures. The figures associated with this disclosure typically are not drawn with dimensional accuracy to scale, i.e., such drawings have been drafted with a focus on clarity of viewing and understanding rather than dimensional accuracy.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application and business related constraints, and that these specific goals will vary from one implementation to another and from one developer to another. Moreover, it will be appreciated that such a development effort might be complex and time-consuming but would nevertheless be a routine undertaking of engineering for those of ordinary skill in the art having the benefit of this disclosure.

Use of directional terms such as "upper," "lower," "above," "below", "in front of," "behind," etc. are intended to describe the positions and/or orientations of various components of the invention relative to one another as shown in the various Figures and are not intended to impose limitations on any position and/or orientation of any embodiment of the invention relative to any reference point external to the reference. Herein, "left" and "right" are from the perspective of an operator of a lift truck when the operator is in front of the truck facing the fork frame. Herein, "lateral" refers to directions to the left or the right and "longitudinal" refers to a direction perpendicular to the lateral direction and to a plane defined by the fork frame.

Those skilled in the art will recognize that numerous modifications and changes may be made to the various embodiments without departing from the scope of the claimed invention. It will, of course, be understood that modifications of the invention, in its various aspects, will be apparent to those skilled in the art, some being apparent only after study, others being matters of routine mechanical, chemical and electronic design. No single feature, function or property of the first embodiment is essential. Other embodiments are possible, their specific designs depending upon the particular application. As such, the scope of the invention should not be limited by the particular embodiments herein described but should be defined only by the appended claims and equivalents thereof.

Representative Embodiment—Structure

Figure 1:
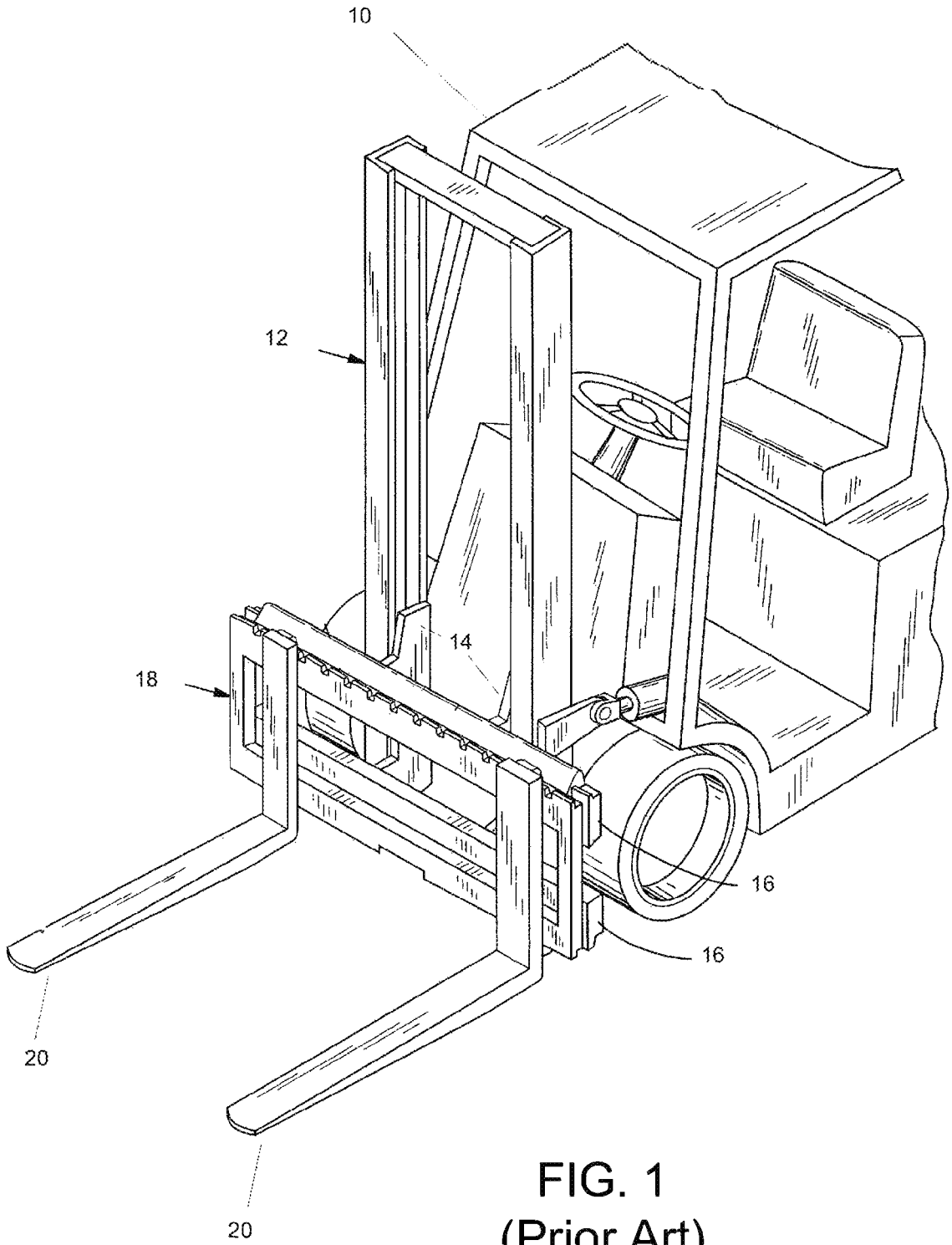
FIG. 1 (Prior Art)
FIG. 1 is an isometric view of a prior art lift truck, illustrating typical components of a lift truck equipped with forks.
Figure 2:
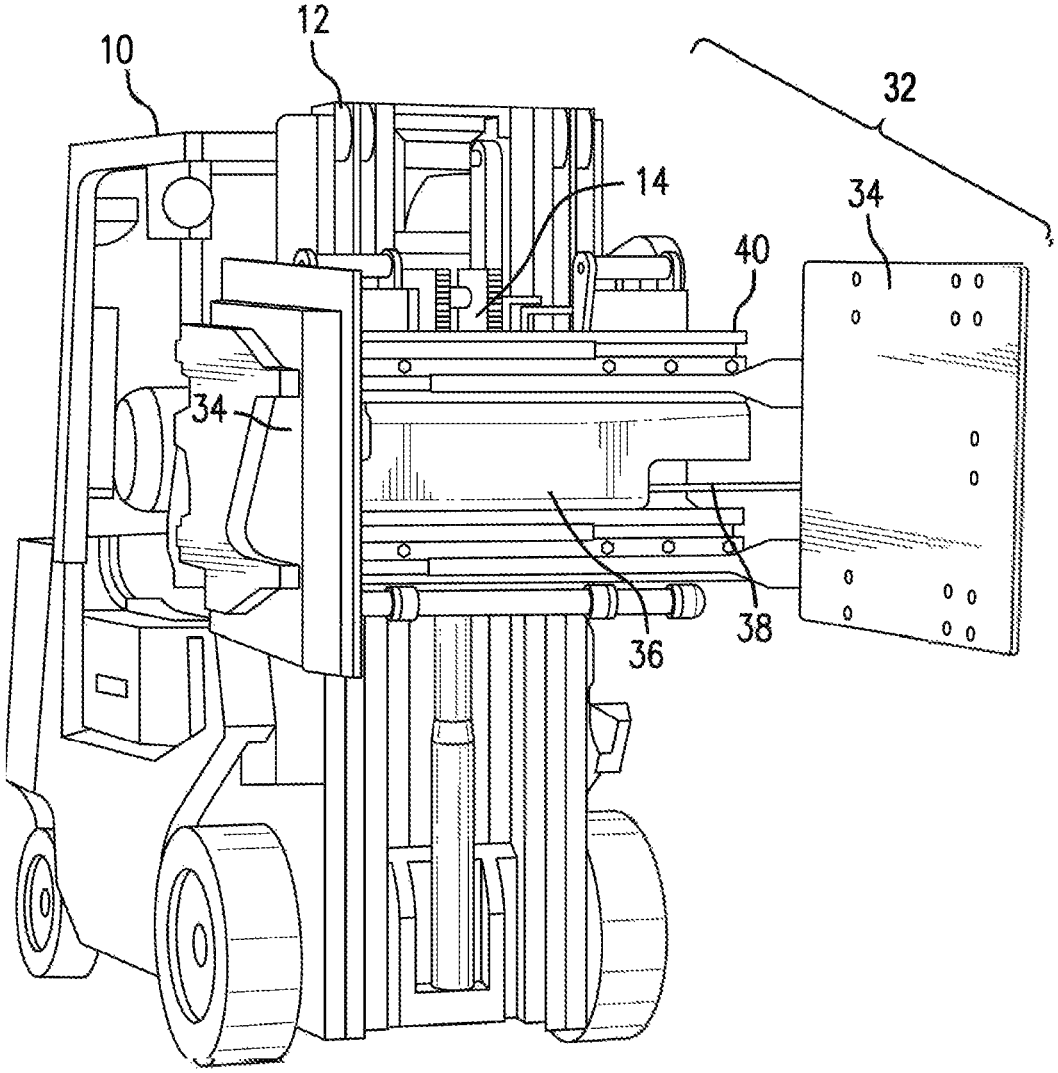
FIG. 2 (Prior Art)
FIG. 2 is an isometric view of a prior art lift truck, illustrating typical components of a lift truck equipped with a load clamp assembly.
Figure 3:
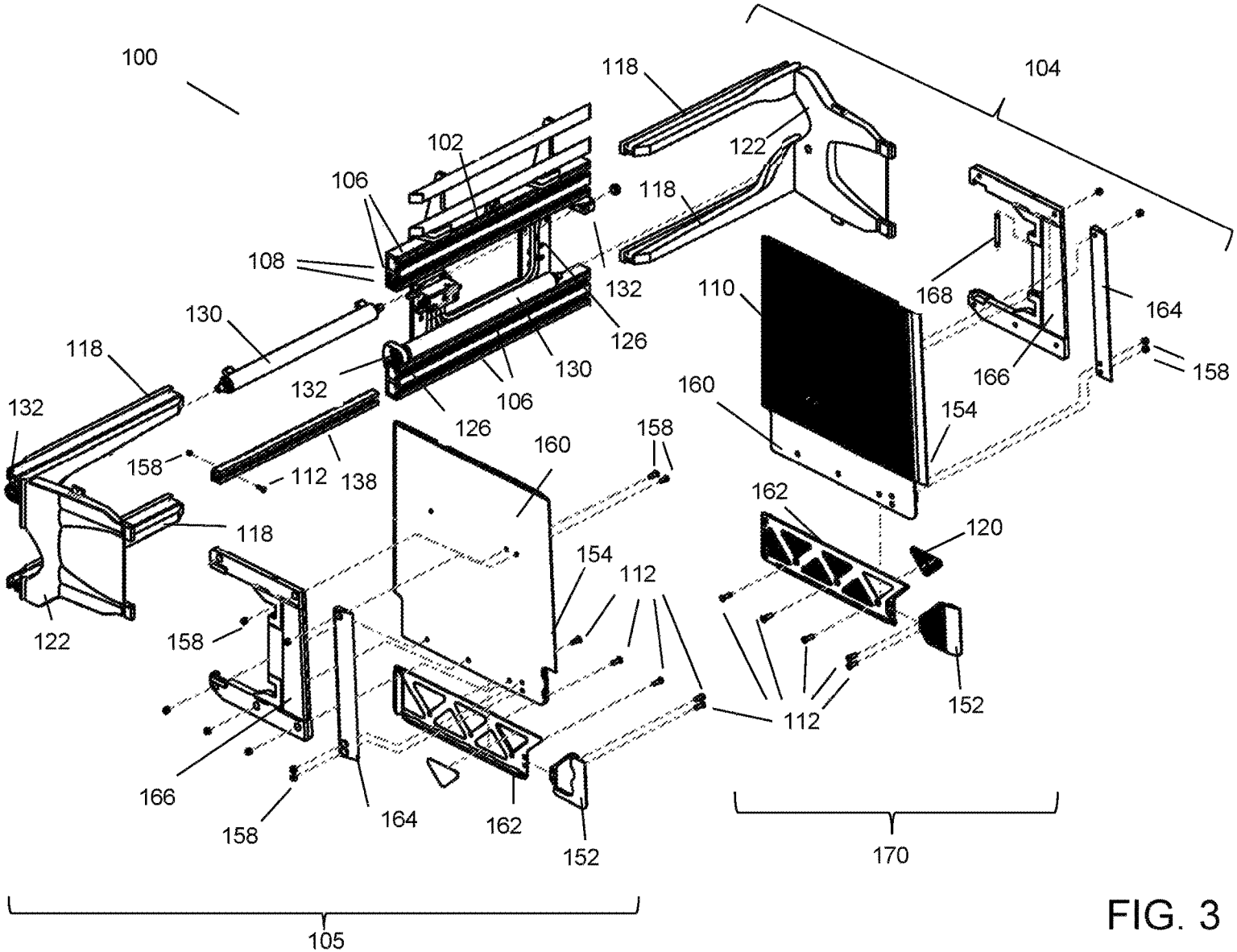
FIG. 3 is an exploded isometric front left view of a representative embodiment of a raked blade load clamp.
Figure 4:
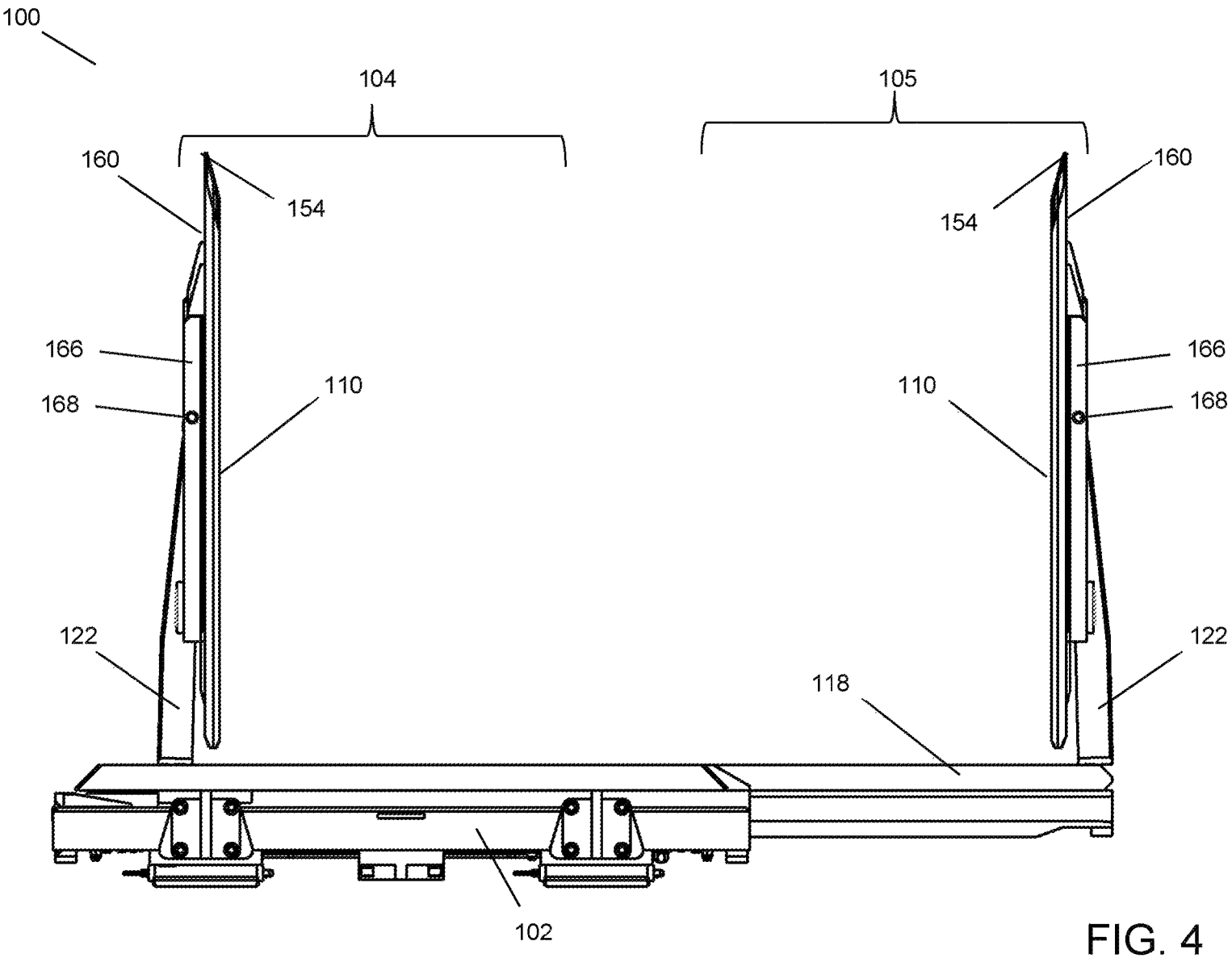
FIG. 4 shows a top view of the raked blade load clamp.

FIG. 3 shows an exploded isometric front left view of a representative embodiment of a raked blade load clamp 100. FIG. 4 shows a top view of the raked blade load clamp 100. The raked blade load clamp 100 comprises a frame 102, a right clamp arm 104, a left clamp arm 105 and two actuators 130. Each actuator 130 is coupled to the frame 102 and to one of the clamp arms 104, 105. The actuators 130 are configured to pull the clamp arms 104, 105 together or push them apart. The actuators 130 are further configured to act in tandem to provide a small amount of side shift to the clamp arms 104, 105, allowing an operator approaching a load a lift truck 10 to make a small adjustment lateral of the clamp arms 104, 105 if the lift truck 10 is not perfectly lined up with the load. The maximum side shift from center line that can be provided this way is one half of the cylinder stroke of the actuators 130 (one actuator 130 fully retracted, the other actuator 130 fully extended).

The frame 102 is configured to be coupled to a carriage 14 of a lift truck 10. The frame 102 comprises four guide channels 106 coupled to two frame vertical beams 126, with two guide channels 106 positioned near a top of the frame 102 and two guide channels 106 positioned near the bottom of the frame 102. In the representative embodiment, the upper two guide channels 106 share a common channel wall and the lower two guide channels 106 are similar. However, in other embodiments, the guide channels 106 do not necessarily have common walls with adjacent guide channels 106. Two actuator brackets 132 are coupled to the frame 102, one coupled to a bottom one of a lower of the top two guide channels 106, and the other coupled to a top of an upper one of the bottom two guide channels 106. The upper actuator bracket 132 is position on the right of the frame 102 and the lower actuator bracket 132 is located on the left of the frame 102, when viewed from the front. The raked blade load clamp 100 is in a closed configuration when the clamp arms 104, 105 are as close together as the actuators 130 can pull them. The raked blade load clamp 100 is in an open configuration when the clamp arms 104, 105 are as far apart as the actuators 130 can push them.

Each of the guide channels 106 has a guide channel cavity 108. The guide channels 106 each have a guide channel slot on the front, opening to the guide channel cavity 108. Each guide channel 106 has a channel bearing 138, positioned inside the guide channel cavity 108 and shaped to conform to thereto, and with its own interior cavity that is similarly shaped, but slightly smaller. The channel bearing 138 is detachable coupled to the guide channel 106. In the first exemplary embodiment, the channel bearing 138 is detachably coupled to the guide channel 106 with a removable fastener scheme such as the cap screws 112 and nut 158 shown, but in other embodiments, other fastening schemes may be used. The channel bearings 138 comprise suitable bearing material that provides low friction and is softer than the components it has sliding contact with in order to preferentially wear. Since the channel bearings 138 are removable, they can be easily replaced when worn down.

Each of the clamp arms 104, 105 has a clamp assembly 170 that is coupled to two clamp sliding beams 118 via a clamp hinge plate 166, and a clamp arm bracket 122. One of the two clamp sliding beams 118 is coupled to an actuator bracket 132, which couples to the actuator 130. The two clamp sliding beams 118 of each of the clamp arms 104, 105 are configured to slidingly fit into two of the guide channels 106 of the frame 102. The clamp hinge plate 166 is coupled to the clamp arm bracket 122 with one or more hinge pins 168.

The clamp assembly 170 comprises a clamp pad 110, a clamp plate 160, a shoe plate 162, a toe plate 152, and a plurality of shoe pads 120. The clamp plate 160 is configured for coupling to the clamp hinge plate 166. In the representative embodiment, the outside of the clamp plate 160 is coupled to the clamp hinge plate 166 with a plurality of cap screws 112 and nuts 158, but in other embodiments may be coupled by welding or other suitable joining mechanism. A clamp back bar 164 is coupled to the clamp plate 160 forward of the clamp hinge plate 166. The clamp plate 160 typically comprises aluminum but may comprise other suitable materials.

The clamp pad 110 is coupled to an inside surface of the clamp plate 160, covering most of the inside surface of the clamp plate 160. The clamp pad 110 does not cover a portion of the inside surface of the clamp plate 160 where the shoe plate 162 attaches. The clamp pad 110 comprises a high friction, compressible and resilient material, such as rubber or polyurethane. The clamp pad 110 may be grooved to improve friction and compressibility. The clamp pad 110 may have a surface pattern of contrasting colors to make it more visible and distinguishable when in proximity to a load. In other embodiments, other surface patterns, such as checkerboard may be used.

Figure 7B:
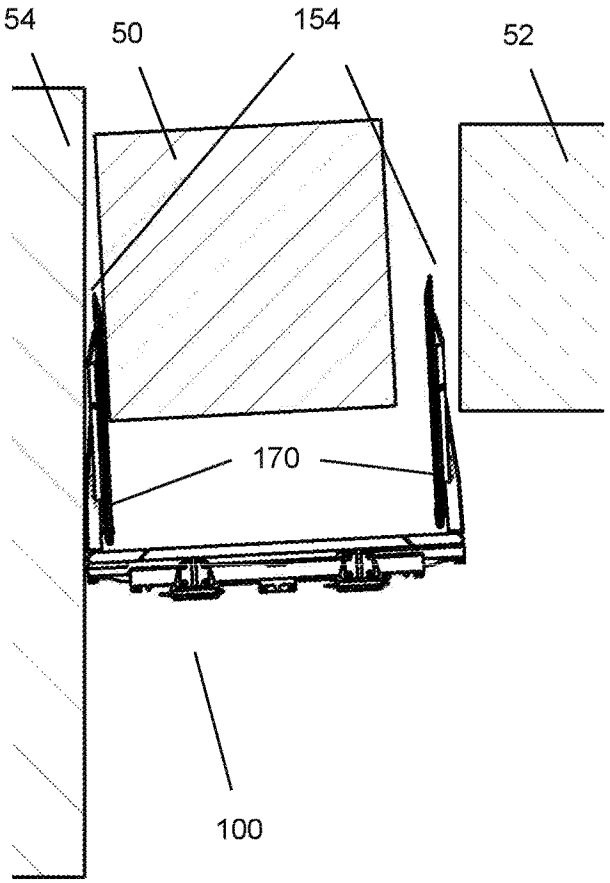
FIG. 7B shows a top view of a raked blade load clamp with the clamp leading edge more fully inserted between a target carton an adjacent wall.
Figure 9:
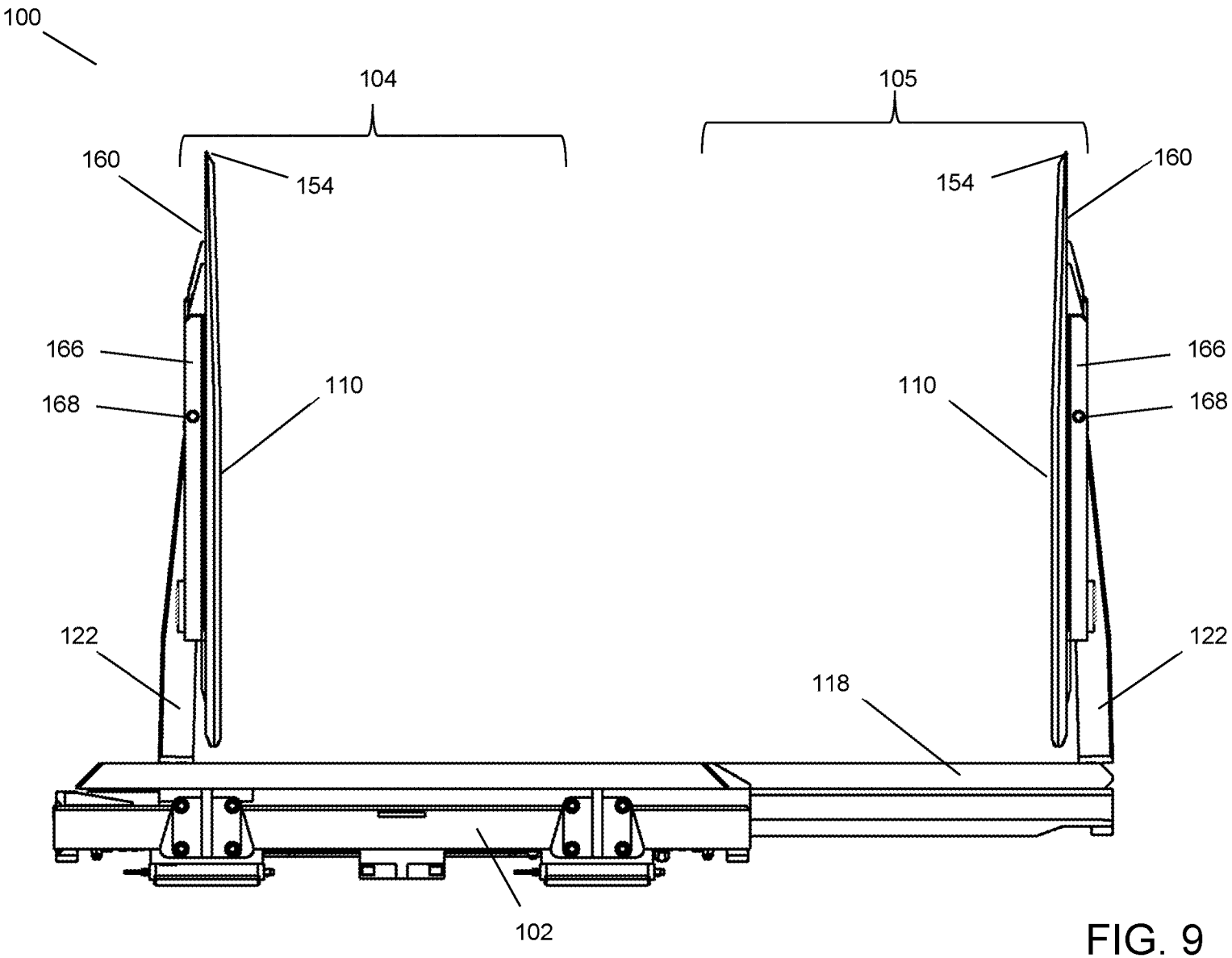
FIG. 9 shows a top view of an alternative embodiment raked blade load clamp with the beveled portion of the clamp plate extending under the clamp pad.

Each clamp assembly 170 has a clamp leading edge 154 that is raked back from bottom to top. In the representative embodiment, the clamp leading edge 154 is raked back at an angle between 3 and 4 degrees from vertical. In some embodiments, the clamp leading edge 154 is raked back more than 4 degrees from vertical. The clamp leading edge 154 is also angled inward from the front edge, giving the clamp leading edge 154 a blade edge with the inside surface of the clamp plate 160 beveled. This makes the tip of the clamp leading edge 154 sufficient and the angle back from the clamp assembly 170 at a sufficiently shallow angle to pry a target carton away from other adjacent objects but does not reduce too much effective gripping area. The inward-angled edge and the rake back on the clamp leading edge 154 facilitates insertion of the raked blade load clamp 100 between a target carton 50 and adjacent cartons 52 or between the target carton 50 and a wall 52 (see FIGS. 7A and 7B). Typically, the clamp leading edge 154 has a thickness of ⅛ inch at the tip and angles back at a 15 degree angle off parallel with the clamp plate 160 until the full thickness of the clamp plate 160 is reached. In other embodiments, the clamp leading edge 154 has a blade edge that angles outward from the front edge, giving the clamp leading edge 154 a blade edge with the outside surface of the clamp plate 160 beveled. In other embodiments, the clamp leading edge 154 has a blade edge that is beveled on both sides of the clamp plate 160. In some embodiments, the inside surface of the clamp plate 160 is beveled to the clamp pad 110, and in yet other embodiments, the inside surface of the clamp plate 160 is beveled under the clamp pad 110, in some embodiments all the way back to the centerline of the clamp plate 160, with the clamp pad 110 following the contour of the beveled clamp plate 160 (see FIG. 9).

Figure 5:
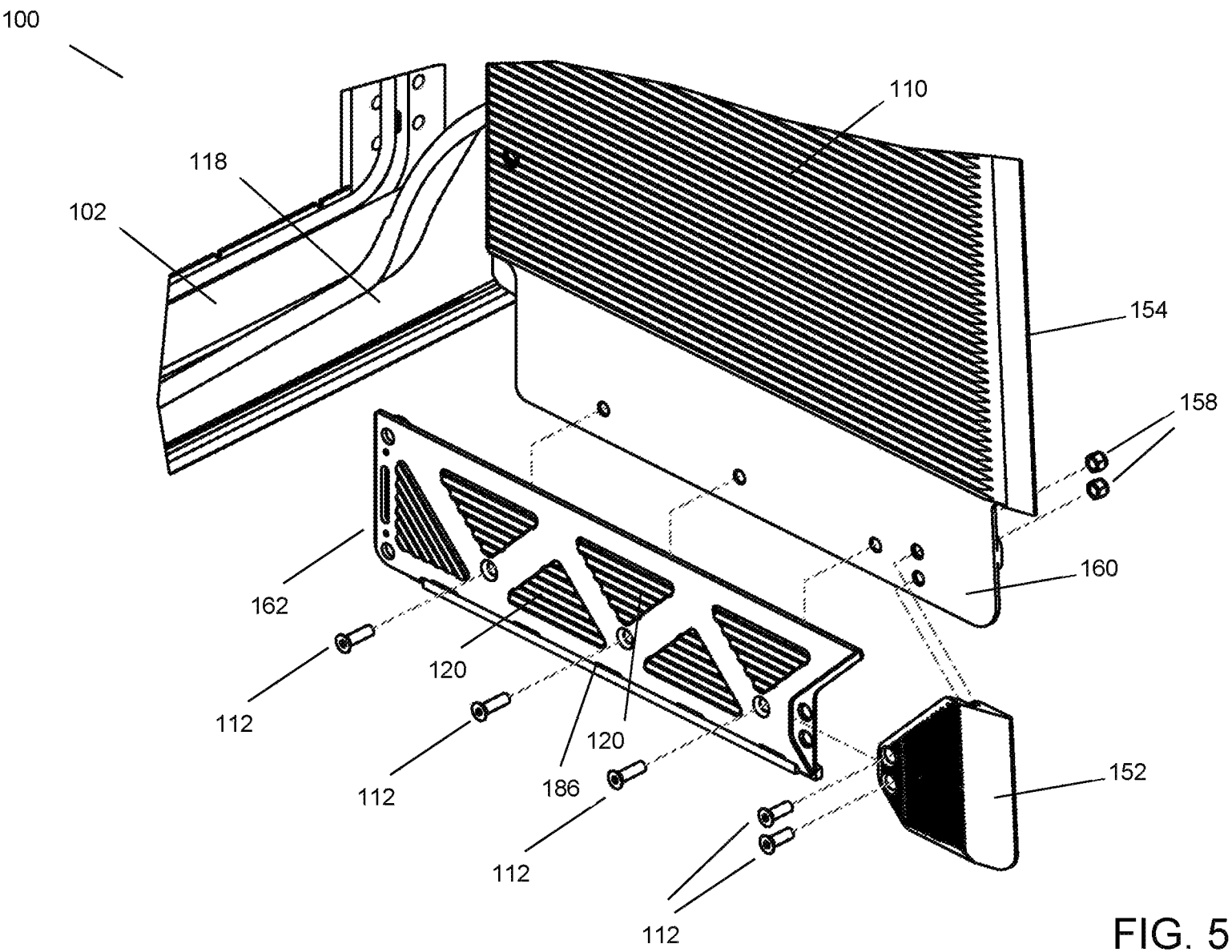
FIG. 5 shows a detailed view of the raked blade load clamp.
Figure 6:
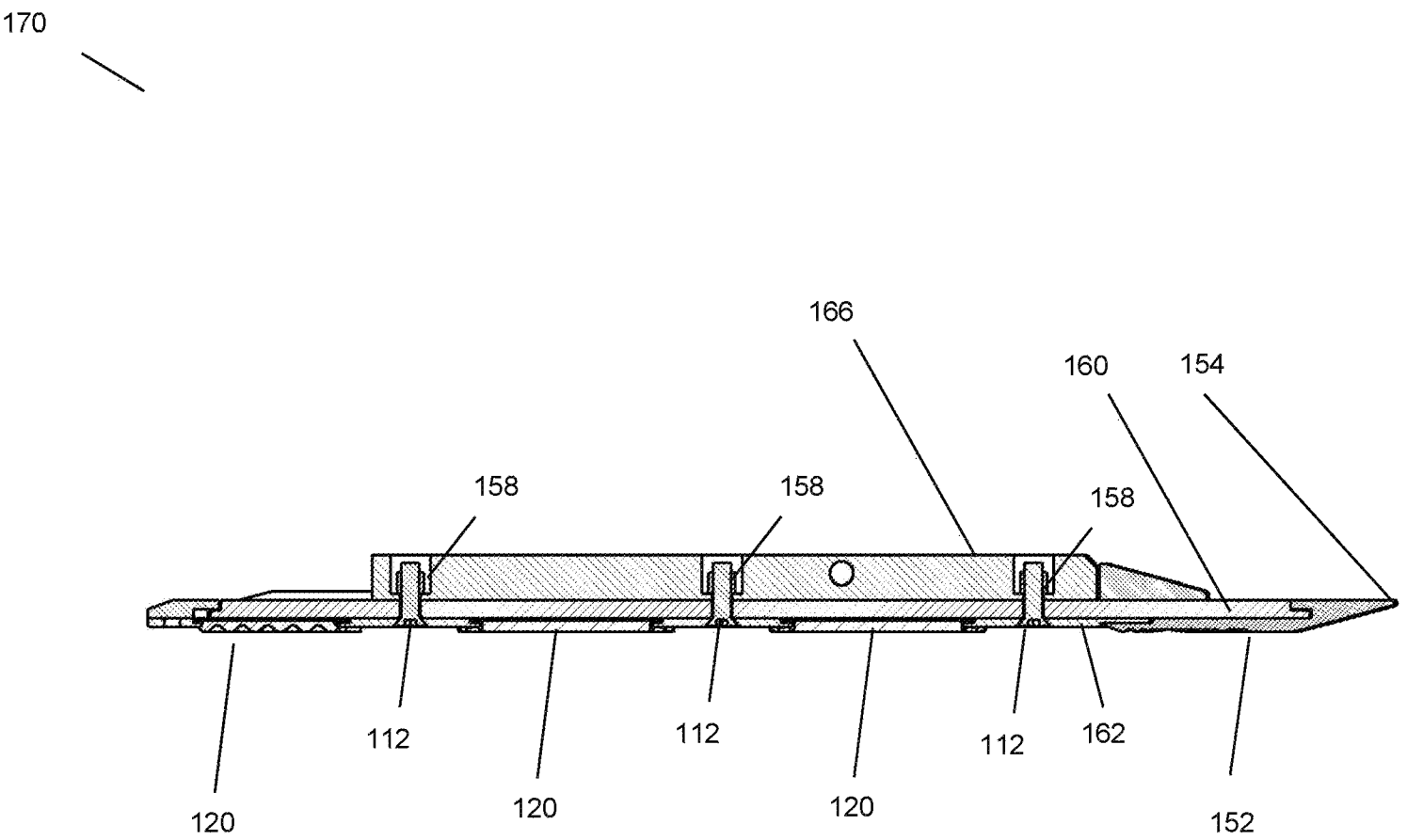
FIG. 6 shows top sectional view of the clamp assembly 170.

FIG. 5 shows a detailed view of the raked blade load clamp 100. FIG. 6 shows top sectional view of the clamp assembly 170. A toe plate 152 is coupled to a front portion of the shoe plate 162 and together they are coupled to the clamp plate 160 with cap screws 112. The front edge of the toe plate 152 aligns with a front edge of the clamp plate 160 and together they form the clamp leading edge 154. The toe plate 152 is configured for accepting insertion of a lower portion of the clamp plate 160. The toe plate 152 is separate from the shoe plate 162 because its leading edge is very thin and will wear out fairly quickly and need to be replaced more often than the shoe plate 162. Since pallets are sometimes used for carrying a carton or other load and pallets can be very destructive to rubber surfaces, the toe plate 152 and the shoe plate 162 are a height (typically 7 inches) that is slightly higher than a standard pallet so these smaller, less expensive and more easily replaceable parts will contact the pallet and not the larger and more expensive clamp pad 110.

In some alternative embodiments, there is no toe plate 152 and the clamp plate 160 extends into its place instead. In yet other embodiments, the clamp assemblies 170 are not raked back, but have vertical leading edges, and instead have toe plates 152 that extend forward of the leading edges of the clamp plates 160.

The shoe plate 162 has shoe plate wear elements 186 coupled to the bottom edge of the shoe plate 162 and serve as the main contact point between the shoe plate 162 and the floor, road or other surface upon which the load to be picked up rests. In the representative embodiment, shoe plate wear elements 186 are welded to the shoe plate 162. In other embodiments, the shoe plate wear element 186 may be a plate that is pinched between the shoe plate 162 and the clamp plate 160, thereby holding it in place. The shoe plate wear element 186 may be penetrated by one or more of the cap screws 112 that secure the shoe plate 162 to the clamp plate 160, helping to hold the shoe plate wear element 186 in place.

The shoe plate 162 typically comprises steel but may comprise other suitable materials. The toe plate 152 and shoe plate wear elements 186 are comprised of a hard material with high resistance to abrasion, such as Mangalloy, a steel alloy, containing 0.8 to 1.25% carbon, with 11 to 15% manganese. In other embodiments, other hard materials may be used. Anytime when the operator of the lift truck 10 drags a load across the floor with the raked blade load clamp 100 low enough to contact the floor, the toe plate 152 and the shoe plate wear elements 186 will most likely be the only parts in contact with the floor and will most likely endure the most wear.

The shoe pads 120, like the clamp pad 110, comprise a high friction, compressible and resilient material, such as rubber or polyurethane. The shoe pads 120 may be grooved to increase compressibility and friction. Each of the shoe pads 120 has a lip along the periphery (edge) of the shoe pad 120 to help secure it between the shoe plate 162 and clamp plate 160.

Representative Embodiment—Operation

Figure 7A:
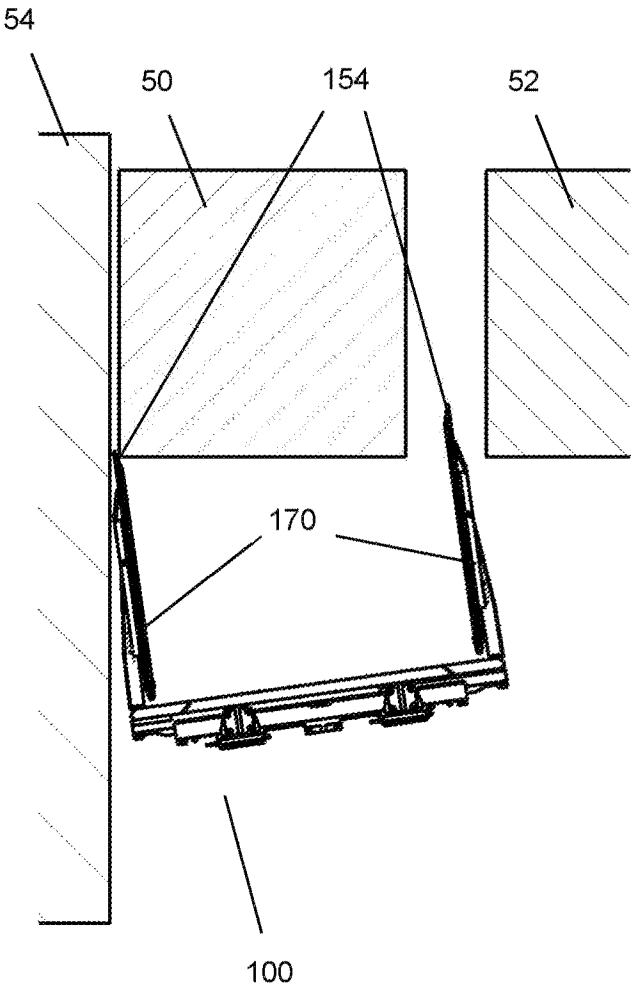
FIG. 7A shows a top view of a raked blade load clamp maneuvering a clamp leading edge between a target carton an adjacent wall.

The lift truck 10 can be driven towards a target carton 50 that is adjacent to a wall 54 or another carton 52 (see FIG. 7A). The lower corner of the clamp leading edge 154 of one of the clamp assemblies 170 can be positioned using the associated actuator 130 to the gap or contact point between the target carton 50 and the adjacent wall 54 or carton 52. The other clamp assembly is positioned on the other side of the target carton 50. The lift truck 10 can then move forward and the clamp leading edges 154 push in between the target carton 50 and the adjacent wall 54 or carton 52, creating a gap as necessary by moving the target carton 50 laterally. The raked back angle of the clamp plate leading edges 154 eliminates the need to align each entire clamp leading edge 154 with the edge of the target carton 50. Once the lower corners of the clamp leading edges 154 are inserted in between the cartons, the inward angled surfaces of the clamp leading edges 154 push the target carton 50 as needed to align it with the clamp arms 104, 105.

Usually the clamp pads 110 contact and grip the load. In some circumstances, if the size and pattern of the shoe pads 120 are suitable and the alignment of the load is favorable, the shoe plate 162 contacts and grips the load. Once the clamp assemblies 170 have securely engaged the load, the carriage 14 of the lift truck 10 is raised, along with the raked blade load clamp 100 and the load 50. The operator then drives the lift truck 10 to where the load is desired. Alternatively, once the clamp assembly 170 has securely engaged the load, the operator may drive the lift truck in reverse without lifting the carriage 14. The toe plate 152 and shoe plate wear elements 186 of the clamp plate assemblies 170 drag along the floor or pavement, protecting the other components of the clamp plate assemblies 170 from wear.

Figure 8B:
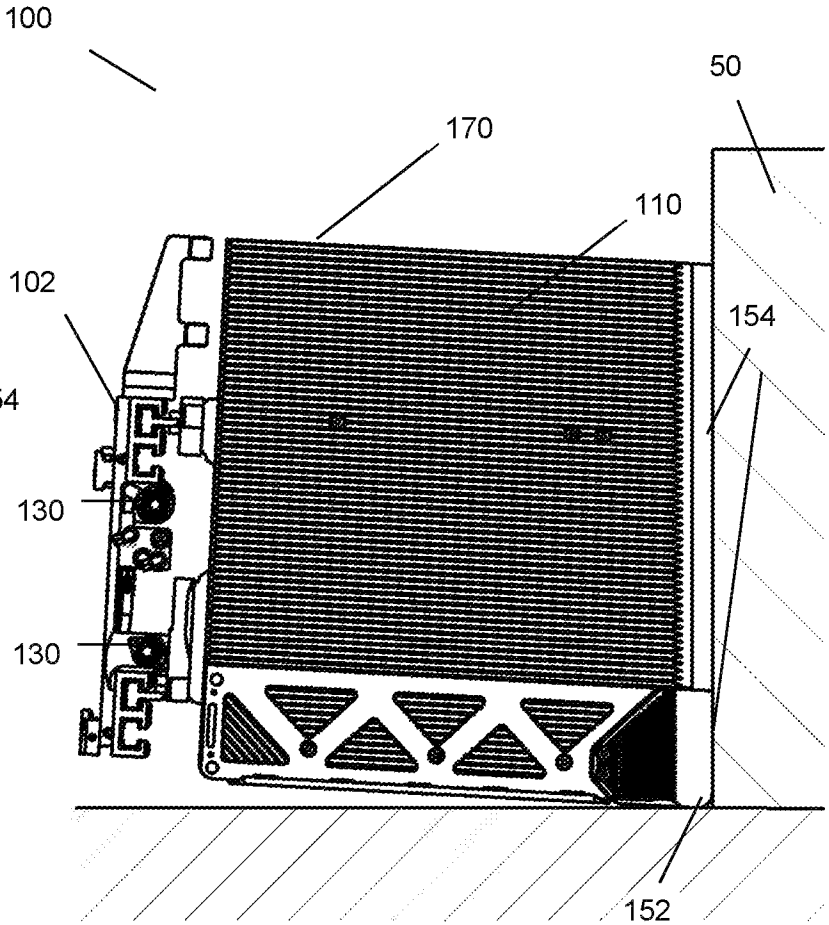
FIG. 8B shows a view from the left of the right half of the raked blade load clamp in a tilted forward orientation.
Figure 8A:
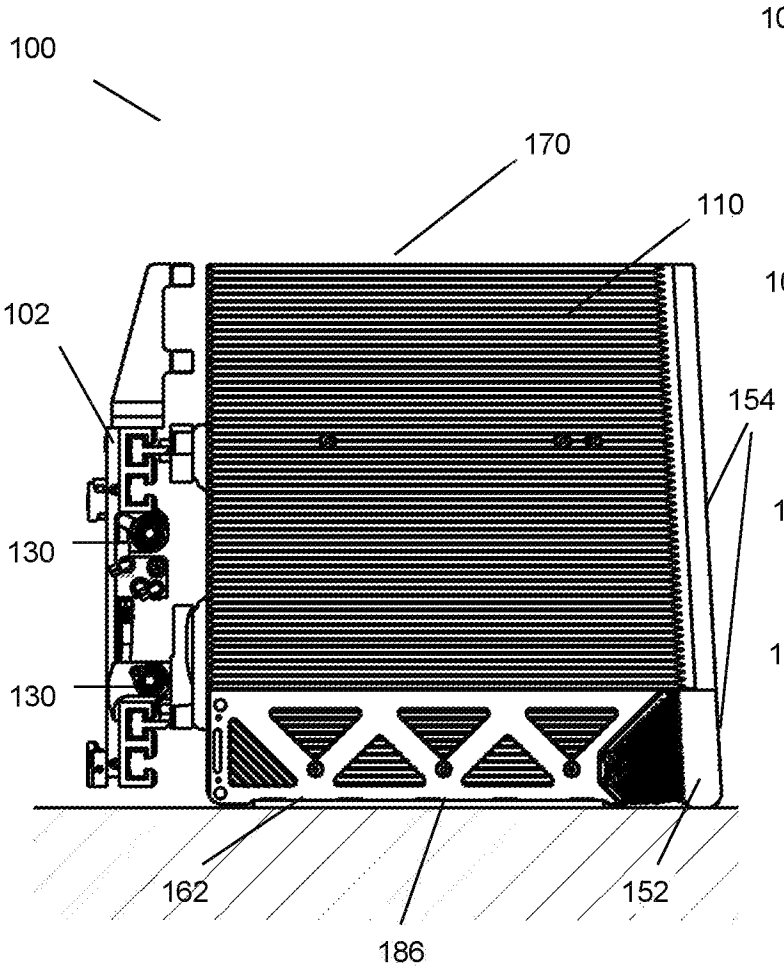
FIG. 8A shows a view from the left of the right half of the raked blade load clamp in a level orientation.

In some circumstances, it is desirable to push a carton 50 with the clamp leading edges 154 instead of clamping the carton 50. However, the raked back angle on the clamp leading edges 154 would mean that only the lower corners of the clamp leading edges 154 would contact the carton 50, which may damage the carton 50 as it would put too much force on the point of contact. Most lift trucks 10 have the ability to tilt forward the raked blade load clamp 100 lifting up the back end of the raked blade load clamp 100 and/or pushing down the front end (See FIGS. 8A and 8B). The 3 to 4 degrees of rake back on the clamp leading edges 154 matches the amount of forward tilt that a lift truck 10 can typically put on an attached load handler such as the raked blade load clamp 100. The contact between the clamp leading edges 154 and the carton 50 now is along the entire length of the clamp leading edges 154, spreading out the force when pushing and reducing the risk of damage to the carton 50.

The clamp assembly 170 is designed for easy replacement of the toe plate 152, the shoe pads 120 and the shoe plate wear elements 186 when one or more become worn or damaged. Replacement of one or more of the shoe pads 120 is cheaper than replacement of a pad that covers all of the interior surface of the clamp plate 160 and replacement of the shoe plate wear elements 186 is less expensive than replacement of shoe plate 162 or the clamp plate 160. The cap screws 112 and nuts 158 holding, the toe plate 152 and the shoe plate 162 to the clamp plate 160 are removed. Then the toe plate 152 and the shoe plate 162 are slid down and off the lower end of the clamp plate 160. The toe plate 152, the shoe pads 120 and the shoe plate wear elements 186 may be removed from the shoe plate 162 and replaced as needed. Then the toe plate 152 and the shoe plate 162 are slid back onto the lower end of the clamp plate 160, with the shoe pads 120 pinched between the shoe plate 162 and the clamp plate 160. Portions of the shoe plate wear elements 186 are likewise held in place, pinched between the shoe plate 162 and the clamp plate 160. The toe plate 152 and the shoe plate 162 are then secured with cap screws 112.

What is claimed is:

1. A lift truck load handler comprising:

a clamp leading edge;

a first clamp plate with an inside surface, an outside surface, a bottom edge and a front edge, wherein the front edge of the first clamp plate forms at least part of the clamp leading edge;

a second clamp plate;

wherein the inside surface of the first clamp plate is oriented facing the second clamp plate; and wherein the clamp leading edge is raked up and back from a vertical axis of the first clamp plate, wherein the vertical axis of the first clamp plate is orthogonal to the bottom edge of the first clamp plate.

2. The lift truck load handler of claim 1 further comprising:

wherein the clamp leading edge has a blade edge.

3. The lift truck load handler of claim 1, wherein the clamp leading edge has a blade edge, angled inward and back from the outside surface to the inside surface of the first clamp plate.

4. The lift truck load handler of claim 1, wherein the clamp leading edge has a blade edge with a width of no more than ⅛ inch from the outside surface to the inside surface of the first clamp plate, angled inward and back from the outside surface to the inside surface of the first clamp plate no more than 15 degrees off parallel with the first clamp plate.

5. The lift truck load handler of claim 1, further comprising:

wherein the first clamp plate has an upper portion and a lower portion, the upper portion with a front edge;

a toe plate with a front edge, the toe plate coupled to the lower portion of the first clamp plate; and wherein the front edge of the toe plate aligns with the front edge of the upper portion of the first clamp plate and together the front edges of the toe plate and the upper portion of the first clamp plate form the clamp leading edge.

6. The lift truck load handler of claim 5, wherein the toe plate is harder and more wear-resistant than the first clamp plate.

7. The lift truck load handler of claim 5, wherein the toe plate wraps around a front edge of the lower portion of the first clamp plate.

8. The lift truck load handler of claim 5, wherein the clamp leading edge is raked up and back at an angle of at least 3 degrees from the vertical axis of the first clamp plate.

9. The lift truck load handler of claim 8, further comprising:

wherein the clamp leading edge is raked up and back at an angle of 3 to 4 degrees from the vertical axis of the first clamp plate.

10. The lift truck load handler of claim 5 further comprising:

wherein the clamp leading edge has a blade edge.

11. The lift truck load handler of claim 5, wherein the clamp leading edge has a blade edge, angled inward and back from the outside surface to the inside surface of the first clamp plate.

12. The lift truck load handler of claim 5, wherein the clamp leading edge has a blade edge with a width no more than ⅛ inch from the outside surface to the inside surface of the first clamp plate, angled inward and back from the outside surface to the inside surface of the first clamp plate no more than 15 degrees off parallel with the first clamp plate.

13. The lift truck load handler of claim 5, a shoe plate detachably coupled to a inside lower portion of the first clamp plate, the shoe plate comprising one or more wear elements coupled to a bottom edge of the shoe plate, the wear elements harder and more wear-resistant than the first clamp plate and the shoe plate, the wear elements extending below the first clamp plate.

14. The lift truck load handler of claim 13, wherein the shoe plate has one or more grip element holes, each grip element hole passing through the shoe plate; and further comprising one or more grip elements detachably coupled to an inside lower portion of the first clamp plate, each grip element having a grip element plateau and a grip element lip, wherein the grip element lip is on a periphery of the grip element, wherein each of the grip elements is positioned with the grip element plateau protruding through one of the one or more grip element holes and with the grip element lip held between the shoe plate and the inside surface of the first clamp plate.

15. The lift truck load handler of claim 14, wherein each of the grip elements comprises a high friction material.

16. A lift truck load handler comprising:

a clamp leading edge;

a first clamp plate with an inside surface, an outside surface, a bottom edge, an upper portion and a lower portion, the upper portion with a front edge;

a second clamp plate;

wherein the inside surface of the first clamp plate is oriented facing the second clamp plate; and a toe plate with a front edge, an inside surface, and an outside surface, the toe plate coupled to the lower portion of the first clamp plate, wherein the front edge of the toe plate extends forward of the front edge of the upper portion of the first clamp plate and forms the clamp leading edge, wherein the clamp leading edge has a blade edge with a width no more than ⅛ inch from the outside surface to the inside surface of the toe plate, angled inward and back no more than 15 degrees off parallel with the toe plate.

17. The lift truck load handler of claim 16, wherein the toe plate is harder and more wear-resistant than the first clamp plate.

18. The lift truck load handler of claim 16, wherein the toe plate wraps around a front edge of the lower portion of the first clamp plate.

19. A lift truck load handler comprising:

a clamp leading edge that is a blade edge;

a first clamp plate with an inside surface, an outside surface, an upper portion, a lower portion, and a bottom edge, wherein the inside surface of the upper portion has a front edge, wherein the front edge of the upper portion of the first clamp plate forms at least part of the clamp leading edge;

a second clamp plate;

wherein the inside surface of the first clamp plate is oriented facing the second clamp plate;

a clamp pad coupled to an inside surface of the first clamp plate; and wherein the first clamp plate is beveled on the inside surface to form the blade edge of the front edge of the upper portion of the first clamp plate.

20. The lift truck load handler of claim 19, further comprising:

wherein the first clamp plate is beveled on the inside surface from the front edge inward and back to the clamp pad.

21. The lift truck load handler of claim 19, further comprising:

wherein the first clamp plate is beveled on the inside surface from the front edge inward and back to the clamp pad and under the clamp pad.

22. A lift truck load handler comprising:

a clamp leading edge that is a blade edge;

a first clamp plate with an inside surface, an outside surface, an upper portion, a lower portion, and a bottom edge, wherein the inside surface of the upper portion has a front edge, wherein the front edge of the upper portion of the first clamp plate forms at least part of the clamp leading edge;

a second clamp plate;

wherein the inside surface of the first clamp plate is oriented facing the second clamp plate;

a toe plate with a front edge, the toe plate coupled to the lower portion of the first clamp plate; and wherein the front edge of the toe plate collinearly aligns with the front edge of the upper portion of the first clamp plate and together form the clamp leading edge.

23. A lift truck load handler comprising:

a clamp leading edge that is a blade edge;

a first clamp plate with an inside surface, an outside surface, an upper portion, a lower portion, and a bottom edge, wherein the inside surface of the upper portion has a front edge;

a second clamp plate;

wherein the inside surface of the first clamp plate is oriented facing the second clamp plate;

a toe plate with a front edge, the toe plate coupled to the lower portion of the first clamp plate; and wherein the front edge of the toe plate collinearly aligns with the front edge of the first clamp plate and together form the clamp leading edge;

a clamp pad coupled to the inside surface of the first clamp plate; and wherein the clamp leading edge is angled inward and back from the front edge of the upper portion of the first clamp plate to the clamp pad.

* * * * *